US007505603B2

(12) United States Patent
Yoo

(10) Patent No.: US 7,505,603 B2
(45) Date of Patent: Mar. 17, 2009

(54) DYNAMIC MICRO SPEAKER WITH DUAL SUSPENSION

(75) Inventor: Ok-Jung Yoo, Gyungig-do (KR)

(73) Assignee: Jin Young Acoustic Co., Ltd., Seoul (KR)

( * ) Notice: Subject to any disclaimer, the term of this patent is extended or adjusted under 35 U.S.C. 154(b) by 554 days.

(21) Appl. No.: 10/526,322

(22) PCT Filed: Aug. 29, 2003

(86) PCT No.: PCT/KR03/01755

§ 371 (c)(1),
(2), (4) Date: Aug. 31, 2005

(87) PCT Pub. No.: WO2004/021739

PCT Pub. Date: Mar. 11, 2004

(65) Prior Publication Data

US 2006/0098838 A1 May 11, 2006

(30) Foreign Application Priority Data

Aug. 30, 2002 (KR) ..... 10-2002-0051911

(51) Int. Cl.
*H04R 1/00* (2006.01)

(52) U.S. Cl. ..... 381/404; 381/398

(58) Field of Classification Search ..... 381/396, 381/398, 404; 181/171, 172, 173, 157, 161, 181/163

See application file for complete search history.

(56) References Cited

U.S. PATENT DOCUMENTS

2001/0033673 A1 10/2001 Babb et al.
2002/0054691 A1 5/2002 Miyamoto et al.

FOREIGN PATENT DOCUMENTS

| | | |
|---|---|---|
| DE | 10207561 C1 | 4/2003 |
| EP | 0912072 A1 | 4/1999 |
| JP | 58-161391 | 10/1983 |
| JP | 06-38398 | 5/1994 |
| JP | 07-131890 | 5/1995 |
| JP | 10-322796 | 12/1998 |
| JP | 11007285 | 1/1999 |
| JP | 2000-334378 | 12/2000 |

(Continued)

*Primary Examiner*—Brian Ensey
(74) *Attorney, Agent, or Firm*—Hosoon Lee

(57) ABSTRACT

The invention relates to a micro-speaker with a second suspension made of highly resilient material installed inside of the speaker. The speaker is able to provide high level acoustic output with low distortion rate in a wide frequency range with a very small and slim structure and it may prevent a disconnection of a lead connecting the voice coil and the electrode. The speaker includes a yoke, a permanent magnet, a plate, a vibration plate integrated with a first suspension, a voice coil, a frame and a protector. The speaker further comprises a second suspension made of highly resilient material installed between the plate and the vibration plate, and is characterized in that the voice coil is attached to the lower surface of the second suspension and the vibration plate is attached to the upper surface of the second suspension and the vibration plate is attached to the upper surface of the second suspension and the outer periphery of the second suspension is fixed to the frame.

5 Claims, 5 Drawing Sheets

FOREIGN PATENT DOCUMENTS

| | | |
|---|---|---|
| JP | 2001-045594 | 2/2001 |
| JP | 2001-313996 | 11/2001 |
| JP | 2002-152882 | 5/2002 |
| KR | 2001-0074076 | 8/2001 |
| WO | WO01/41496 A2 | 6/2001 |

DYNAMIC MICRO SPEAKER WITH DUAL SUSPENSION

TECHNICAL FIELD

The present invention relates to a micro speaker for use in reproducing sounds through micro electronic equipment (e.g., cellular phones, camcorders, PDAs, digital cameras, notebook computers, LCD TVs, DVDs and the like), and more particularly, to a highly reliable, dynamic micro-speaker that is provided with an additional conductive second suspension into which an excessive vibration-damping function and an electrical signal-transmitting function are incorporated to enable wideband reproduction of high level acoustic output and low distortion while maintaining the speaker in a very small and ultra slim structure.

BACKGROUND ART

Conventional electro-acoustic transducers can be roughly classified into speaker systems comprising a combination of functional units in charge of reproduction in specific frequency ranges such as low, middle and high frequency ranges; general speakers of which a single unit can perform reproduction in entire frequency ranges; micro-speakers for performing reproduction in possibly entire frequency ranges within portable electronic equipment; and receivers and earphones for performing reproduction only in a voice frequency range.

Although there are no prescribed specific criteria for classifying the transducers into general speakers and micro-speakers, it is common to classify them based on external sizes and heights of units themselves thereof. In addition to such classification based on external dimensions, more specific features for clearer classification such as the number of suspensions as damping structures of vibration systems and connection structures from electrode terminals to voice coils in speakers are used as classification criteria. Here, the number of additional suspensions for damping a vibration plate is increased in case of general speakers for performing reproduction in entire frequency ranges in order to transmit sounds in a general free sound field, or a high-functional speaker for large input and extended reproduction of bass sounds. As for connections for supplying electrical signals from terminals to voice coils, soft and resilient copper foils capable of accepting a vibration force from a vibration system, and silk wires constructed by twisting cotton or synthesized threads are used additionally. Even in this case, a great number of copper foils and wires are used for high-functional speakers requiring large input and extension of bass sounds. However, as for micro-speakers that are mainly used in near sound fields and employed in products with very limited spaces for accommodating speakers, including cellular phones, notebook computers and camcorders, it is impossible to use the parts employed in such general speakers, i.e. additional copper foils and silk wires, due to very narrow spaces that will be occupied by parts.

FIGS. 1*a* and 1*b* are views showing the structure of a general micro-speaker.

Such a conventional micro-speaker comprises a magnetic circuit for generating magnetic flux, a vibration system that vibrates due to repulsive force against the magnetic flux acting on the magnetic circuit, and a main body. Here, the magnetic circuit comprises a permanent magnet 8, a yoke 9 with the permanent magnet 8 contained therein, and an upper plate 7 attached to an upper surface of the permanent magnet 8. Further, the vibration system comprises a voice coil 5 fitted into a gap between the permanent magnet 8 and the inner diameter of the yoke 9 and wound up to generate the magnetic flux when an electric current flows thereinto, a vibration plate 2 integrally bonded to the voice coil 5, and a first suspension 3 (also referred to as so-called "edge") extending integrally from an outer periphery of the vibration plate 2. The main body comprises a frame 6 to which the magnetic circuit and the vibration system are fixed, an electrode terminal portion 10 fixed to the bottom of the frame 6 for supplying electric power to the voice coil 5 of the vibration system, and a protector 1 fixed to the top of the frame. The yoke 9 is formed with vents 12 for transmitting sounds.

In such a conventional micro-speaker, the vibration of the vibration plate is damped only with the single suspension 3 integral with the vibration plate. Further, the conventional micro-speaker employs a structure in which the connection of the electrode terminal portion 10 to the voice coil 5 is made by using a residual wire 11, which remains after winding up the voice and is then shaped into a semicircle. For this reason, compared with conventional large infinity speakers, the conventional micro-speaker is subjected to the occurrence of a large amplitude of eccentric vibration accompanied with abnormal sounds throughout the vibration plate since the damping capability of the vibration system is weakened as electrical energy input into the vibration system is increased. Further, since the electric power is supplied through two strands of the residual wire of the voice coil mainly composed of copper, considerable progressive damage naturally occurs as the vibration of the vibration system becomes excessive. This means that as the input energy increases, a distortion phenomenon of reproduced sounds accordingly becomes severer and there is a high possibility of the occurrence of progressive disconnection of the wire.

Moreover, since most of recently sold cellular phones employ 40 poly tones including musical components, the number of electronic equipment requiring wideband reproduction and reproduction of a great deal of sounds is increasing day by day. Therefore, there is a need for a micro-speaker with input power of 1 Watt. Referring to micro-speakers of 17 mm in size that have been mainly used as micro-speakers for cellular phones in die relevant industry, however, allowable input power is merely about 0.5 to 0.6 Watts in case of a height of 4 to 5 mm and most of them reproduce bass sounds of frequencies over 750 Hz.

The fact that a limit frequency of reproduction of bass sounds in the micro-speakers is 750 Hz or higher means that there are no lingering effects of bass and medium-pitched sounds. Therefore, the conventional micro-speakers reproduce only sharp and noisy sounds excluding softness and vividness from the overall reproduced sound quality. Here, if the limit frequency of reproduction of bass sounds is extended to a lower frequency range in a relevant speaker unit in order to extend a frequency range of reproduction of sounds to a low frequency range, the amplitude of vibration in an extended resonance range of bass sounds becomes larger than that before the extension is made, even though the same energy is supplied thereto. For this reason, substantial increases in the distortion and the possibility of the occurrence of disconnection of the wire become much higher.

If the limit frequency of reproduction of bass sounds in a single unit of such a conventional micro-speaker of 17 mm in size which employs a processing method using a single suspension and a voice coil is required to be 400 Hz in consideration of some degree of lingering sounds and a balance of reproduction ranges, the aforementioned problems such as disconnection of the wire and abnormal sounds occur considerably. Accordingly, it is indispensable to greatly reduce the allowable input power to 0.2 to 0.3 Watts in case of the conventional micro-speakers. As a result, reproduced sounds become very small sounds. Consequently, to make micro-speakers having large input power centered on reproduction of a great deal of sounds, the limit frequency of reproduction of bass sounds is necessarily shifted to a range of high-pitched sounds with a small amplitude of vibration as near as possible. In a case of making the micro-speakers be centered on reproduction of high-pitched sound, the allowable input power should be lowered. Thus, the conventional micro-speakers have already exhibited vulnerability and limitation due to an inverse correlation between the reproduced sound quality and the allowable input power.

Therefore, it cannot be expected to remarkably improve the function of such conventional micro-speakers. Consequently, to implement a highly reliable micro-speaker that enables wideband reproduction through high level acoustic output resulting from large electrical input and through extension to a range of bass sounds, it is inevitable to provide an additional innovative damping system having a stable damping function even though vibration is increased, and a vibration adaptive, electrical signal-transmitting structure in which disconnection of a wire does not occur.

However, in view of the aforementioned external features of the very small and ultra slim structure of the existing micro-speakers, it is impossible for the micro-speakers to employ an additional suspension or silk wires as vibration adaptive, electrical signal-transmitting bodies, which are made of cotton or synthesized fiber and then woven and thermally molded and are included in general infinity speakers. Accordingly, there is a need for a micro-speaker that includes a structure having the function of the suspension and the silk wires and simultaneously having two functions of vibration damping and wire disconnection prevention while maintaining the concept of the existing micro-speakers in external dimensions.

DISCLOSURE OF INVENTION

An object of the present invention is to provide a micro-speaker with a second suspension made of highly resilient material contained therein, thereby enabling wideband reproduction due to high level acoustic output in response to input electrical signals and extension of bass sounds with low distortion while maintaining the speaker in a very small and ultra slim structure, and preventing disconnection of a wire connecting a voice coil and an electrode terminal portion.

According to an aspect of the present invention for achieving the object, there is provided a micro-speaker including a yoke, a permanent magnet, a plate, a vibration plate with a first suspension integrated therewith, a voice coil, a frame and a protector, comprising a second suspension which is made of highly resilient material and installed between the plate and the vibration plate. Here, the voice coil is attached to a lower surface of the second suspension, the vibration plate is attached to an upper surface of the second suspension, and an outer periphery of the second suspension is fixed to the frame.

According to a second aspect of the present invention, the second suspension is a highly resilient and conductive leaf spring of which a portion protrudes outside of the frame to be connected to a signal-supplying portion, and a lead of the voice coil is connected to the second suspension.

According to a third aspect of the present invention, the second suspension comprises two suspension sections of which shapes are symmetrical with each other, and the two suspension sections are not electrically connected to each other with a predetermined gap therebetween.

According to a fourth aspect of the present invention, each of the suspension sections comprises a semicircular outer peripheral portion which extends from the electrode terminal portion protruding outside of the frame; an inner peripheral portion which is spaced apart by a predetermined gap from and arranged perpendicularly to the outer peripheral portion and to which the voice coil and the vibration plate are attached; damping diaphragms for performing functions of electrically collecting the outer and inner peripheral portions to each other and damping vertical vibration; and a connection portion to which the lead of the voice coil is connected.

According to a fifth aspect of the present invention, the suspension section is provided with two damping diaphragms, wherein a first damping diaphragm is integrally connected at a position on the outer peripheral portion adjacent to the electrode terminal portion to form a first outer damping support point, and at a position on the inner peripheral portion with a predetermined gap therebetween to form a first inner damping support point, and a second damping diaphragm is integrally connected at a position on the outer peripheral portion opposite to the electrode terminal portion to form a second outer damping support point, and at another position on the inner peripheral portion with a predetermined gap therebetween to form a second inner damping support point.

According to a sixth aspect of the present invention, the protruding portion of the second suspension is bent and fixed to the frame so that the connection of the protruding portion to the signal-supplying portion is made through a spring terminal connection (in a tension type connection).

BEST MODE FOR CARRYING OUT THE INVENTION

Hereinafter, preferred embodiments of the present invention will be described in detail with reference to the accompanying drawings.

Figure 1A:
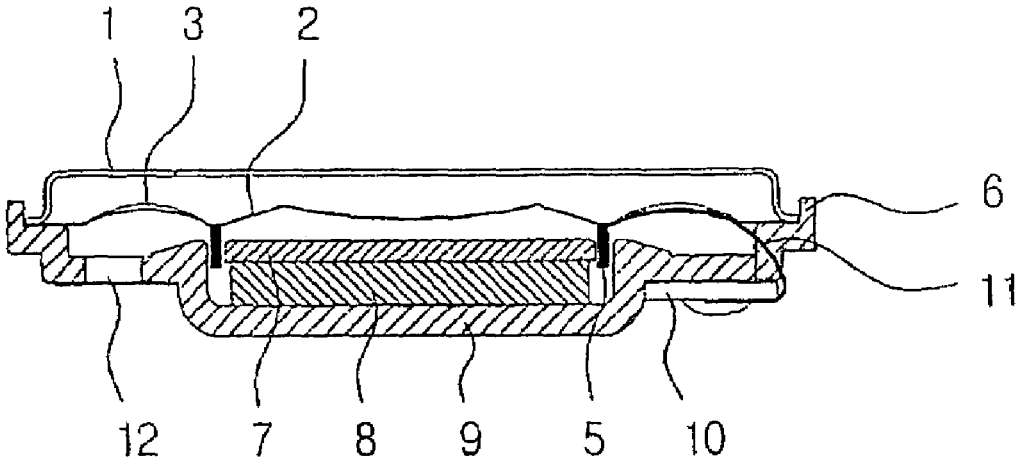
FIG. 1a Prior Art
FIG. 1*a* is a sectional view of a conventional dynamic micro-speaker.
Figure 1B:
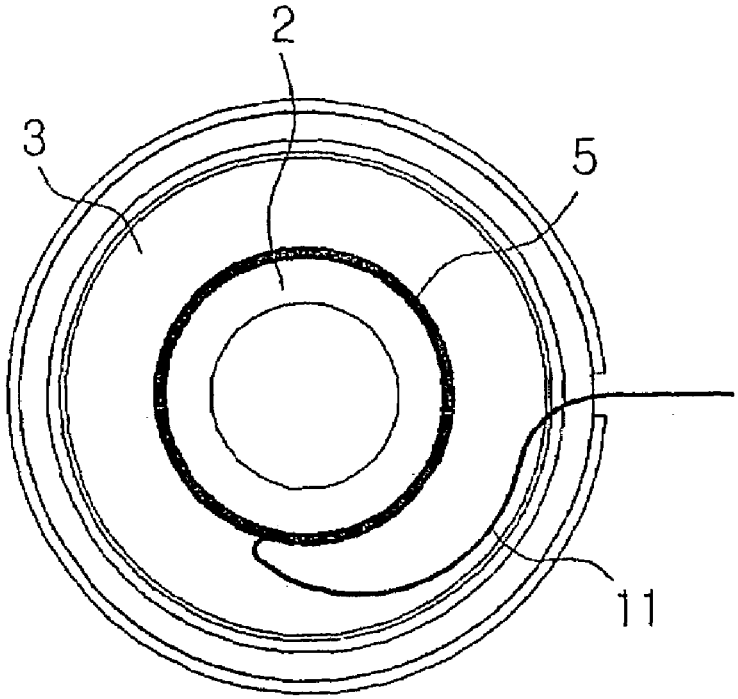
FIG. 1b Prior Art
FIG. 1*b* is a view illustrating a state where a residual wire of a voice coil for supplying electrical signals in the conventional dynamic micro-speaker has been treated.
Figure 2A:
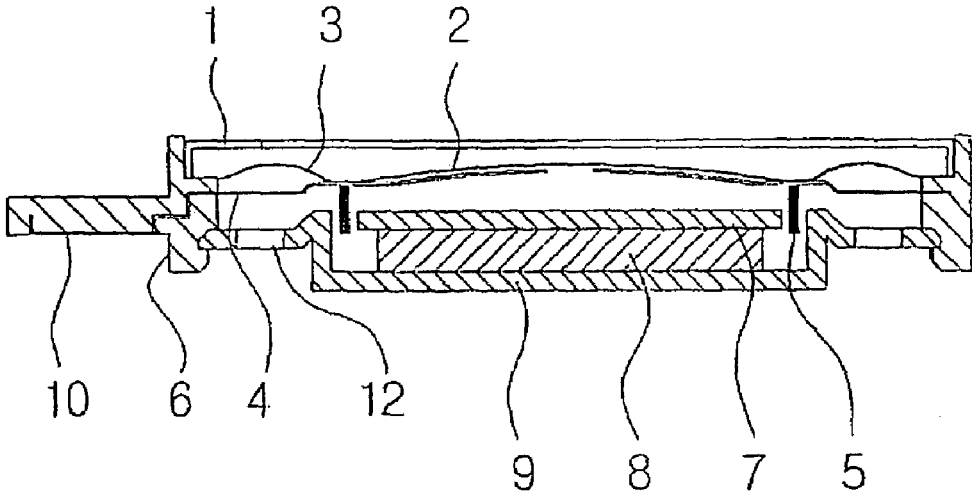
FIG. 2*a* is a sectional view of an internal magnet-type dynamic micro-speaker according to the present invention.

FIG. 2*a* shows a sectional view of an internal magnet-type dynamic micro-speaker according to the present invention.

Elements of the micro-speaker according to the present invention similar to those of the conventional micro-speaker are denoted by like reference numerals in the drawings, and their corresponding functions are also identical with each another.

The main feature of the micro-speaker according to the present invention is the provision of a second suspension 4 comprising a spring (including a leaf spring) made of highly resilient material, and the attachment of a voice coil 5 to a lower surface of the second suspension 4. It is preferred that the second suspension 4 be formed to conform to the shape of the micro-speaker in section. An outer periphery (edge) of the second suspension 4 is fitted into and fixedly seated in a frame 6. The structure of the second suspension 4 will be described later with reference to FIGS. 3*a* to 3*c*.

The second suspension 4 is preferably made of electrically conductive material, but not limited thereto. Any material having high resilience may suffice for the second suspension. If the second suspension 4 is made of electrically conductive material, a lead of the voice coil 5 is connected to the second suspension 4 which in turn is connected to an electrode terminal portion, so that the second suspension 4 can serve as a power supply line for supplying electric power to the voice coil 5. It is also possible to construct a structure in which only the voice coil is attached to the second suspension 4 and a residual wire of the voice coil is inserted into the second suspension 4 and then connected to the electrode terminal portion. It will be apparent to those skilled in the art that various modifications can be made based on the features of the present invention described above. The scope of the present invention is not defined by embodiments to be described later but should be defined by the claims covering all other modifications.

Referring to FIG. 2*a*, in the micro-speaker of the present invention a magnetic circuit comprising a yoke 9, a permanent magnet 8 and a plate 7 is fitted into a lower portion of the frame 6. Further, a protector 1 is seated on an upper portion of the frame 6. A vibration plate 2 on which a first suspension 3 is integrally seated is provided over the plate 7. The second suspension 4 according to the present invention is interposed between the vibration plate 2 and the plate 7. The outer periphery (edge) of the second suspension 4 is fitted into the frame 6 while a portion thereof protrudes outside of and is fixed to the frame 6 so that the portion itself can serve as an electrode terminal portion 10 for receiving input electrical signals and perform the function of transmitting the electrical signals to the voice coil 5. The voice coil 5 is bonded to the bottom or a side portion of the second suspension 4. Further, the second suspension 4 is provided with a space to facilitate vibration of the vibration plate 2, a portion of the vibration plate where the vibration plate 2 meets the first suspension 3 is bonded to the second suspension 4.

Figure 2B:
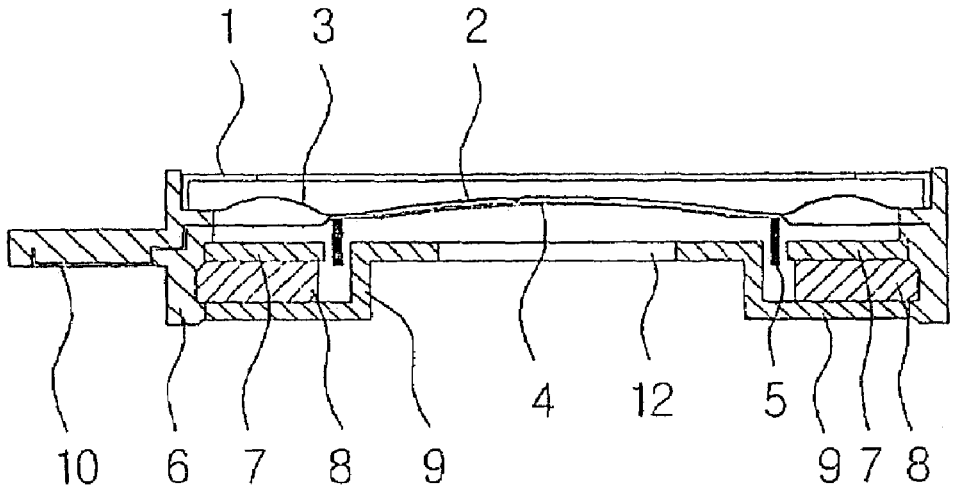
FIG. 2*b* is a sectional view of an external magnet-type dynamic micro-speaker according to the present invention.

FIG. 2*b* is a sectional view of an external magnet-type micro-speaker according to the present invention. A general external magnet-type micro-speaker has been well known, and this figure shows that the technical features of the present invention can be applied to such an external magnet-type micro-speaker.

Figure 3A:
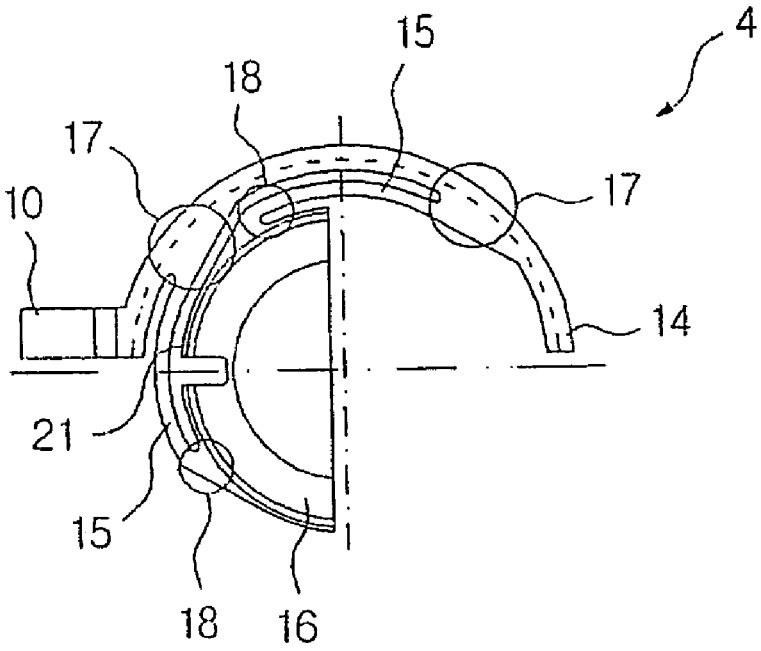
FIGS. 3*a* to 3*c* are plan views of a second suspension according to the present invention.
Figure 3B:
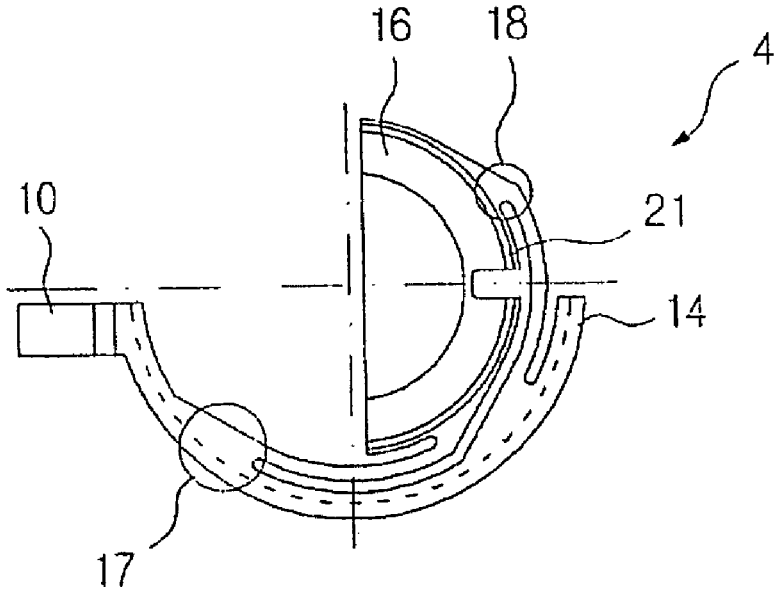
Figure 3C:
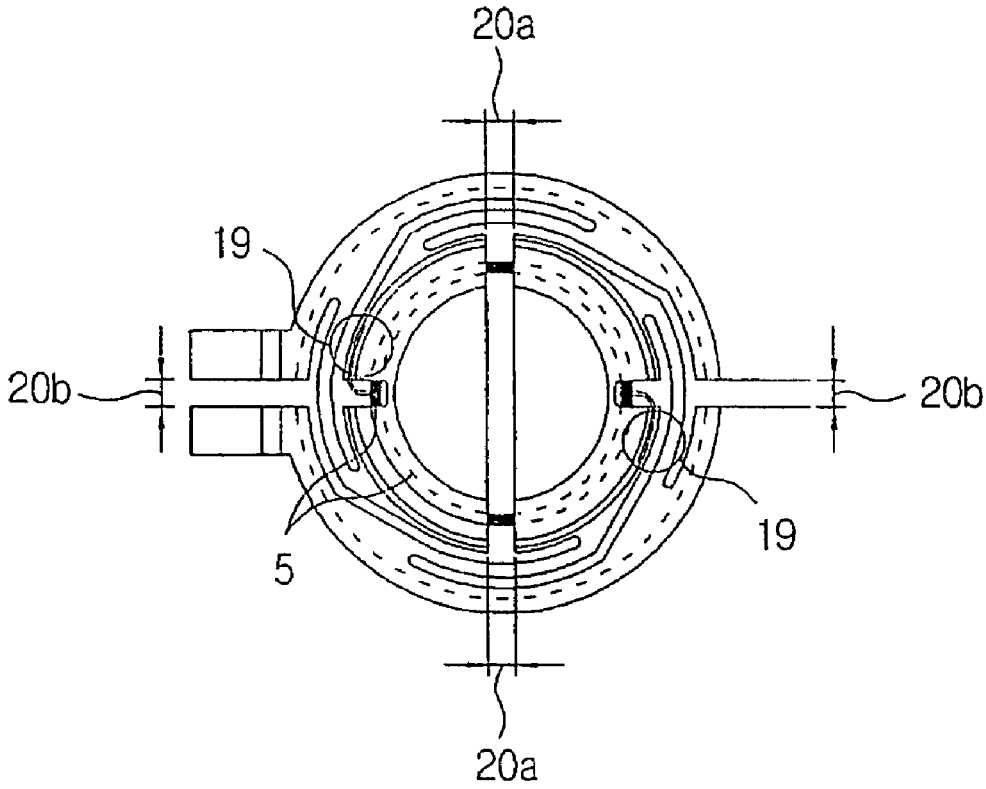

FIGS. 3*a* to 3*c* are views specifically showing the structure of the second suspension 4 according to the present invention, wherein FIGS. 3*a* and 3*b* show a state where a set of suspension sections are separated from each other and FIG. 3*c* shows a state where the set of suspension sections are assembled together.

The second suspension 4 according to the present invention comprises the set of suspension sections spatially separated from each other at a predetermined interval. That is, the set of two suspension sections is constructed to be used as the conductive second suspension 4 in order to exhibit stable damping force against vertical vibration, and is arranged in the form of a plate symmetrical about an upper or upper side portion of the voice coil 5. The respective suspension sections of the second suspension are maintained at a predetermined interval not to be electrically connected to each other.

Each suspension section of the conductive second suspension 4 comprises an outer peripheral portion 14 for supporting the electrode terminal portion 10, which transmits external electrical signals from the outside to the inside, and an outer portion of the suspension section itself; all inner peripheral portion 16 to which the vibration plate 2 and the voice coil 5 will be attached; damping diaphragms 15 formed to have predetermined lengths at predetermined angles so as to mechanically and electrically connect the outer and inner peripheral portions 14 and 16 to each other; and a connection portion 21 formed at an inner distal end of one of the damping diaphragms for electrical connection to the voice coil 5.

The electrode terminal portion 10 of the second suspension 4 protrudes outside of the frame 6, and the outer peripheral portion 14 can be fitted into the frame. The electrode terminal portion 10 may be bonded to the frame by using an adhesive applied to the bottom thereof. Alternatively, according to the thickness of material to be used and requirements for connection to the equipment set, the electrode terminal portion may be a soldering type in which oily an electrode portion protrudes, or a spring terminal type in which a tip thereof is caused to extend and be shaped for connection to an electrode of the equipment set without soldering.

Each suspension section comprises two damping diaphragms 15 each of which has two damping support points 17 and 18 at inner and outer predetermined angular positions thereof, respectively. Since the two suspension sections are used side by side in the embodiment of the present invention, four damping support points are accordingly ensured on either of both sides of the second suspension, thereby securing more stable vibration and damping. Here, two damping diaphragms 15 perform double functions corresponding to those of a silk wire employed in a large infinity speaker which damps vertical vibration and supplies electrical signals from the electrode terminal portion 10 to the voice coil 5.

More specifically, each suspension section of the second suspension is formed with the semicircular outer peripheral portion 14 extending from the electrode terminal portion 10. Further, the suspension section is provided with the inner peripheral portion 16 which is spaced apart by a predetermined gap from and arranged perpendicularly to the outer peripheral portion 14 and to which the voice coil and the vibration plate are attached. Moreover, the suspension section is provided with the two damping diaphragms 15 to perform functions of electrically connecting the outer peripheral portion 14 and the inner peripheral portion 16 to each other and damping vibration. The first damping diaphragm is integrally connected at a position on the outer peripheral portion adjacent to the electrode terminal portion to form a first outer damping support point 17, and at a position on the inner peripheral portion 16 with a predetermined gap therebetween to form a first inner damping support point 18. Further, the second damping diaphragm is integrally connected at a position on the outer peripheral portion opposite to the electrode terminal portion to form a second outer damping support point 17, and at another position on the inner peripheral portion 16 with a predetermined gap therebetween to form a second inner damping support point 18. Moreover, a slit is formed in the middle of the inner peripheral portion and a lead 19 of the voice coil is connected to the connection portion 21 with the slit formed therein.

The assembly shown in FIG. 3*c* is obtained by coupling the respective suspension sections constructed as above. As shown in FIG. 3*c*, the outer peripheral portions and the inner peripheral portions of the suspension sections are placed with predetermined gaps 20*b* and 20*a* therebetween, respectively, so that the two suspension sections cannot be electrically connected to each other.

All the components of each suspension section of the second suspension are not made of separate materials or combinations thereof, but are integrally formed using conductive and highly resilient metal material so that they cannot be electrically disconnected from one another. Materials suitable for the second suspension include sheets of several dozen to several hundred micrometers in thickness made of phosphor bronze, beryllium copper, tungsten alloys, shape memory alloys as titanium-nickel alloys, and the like. As for a method of processing the sheets, an etching or press process, laser processing and a bending process are used.

Meanwhile, although the connection portions 21 provided on the inner side of the second suspension for electrical connection to the voice coil 5 can be connected to the voice coil by means of any methods such as soldering, welding, conductive bonding or bending, the present invention basically proposes the soldering connection.

As for the shape of the second suspension constructed of the two suspension sections that is a major component of the dual suspension micro-speaker according to the present invention, both inner and outer shapes thereof may be a circle or ellipse. In addition, if the suspension sections of the second suspension of the present invention are united into a shape arranged to face each other (including a circle and an ellipse) and the conductive property thereof is not used, they may be employed in conventional micro-speakers.

Figure 4:
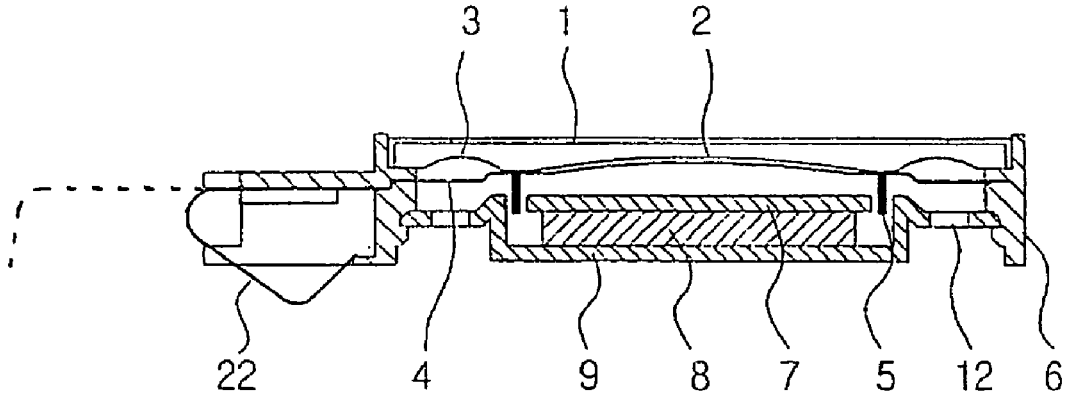
FIG. 4 is a sectional view of an internal magnet-type dynamic micro-speaker according to another embodiment of the present invention.

FIG. 4 is a view showing another embodiment of the micro-speaker according to the present invention.

Figure 5A:
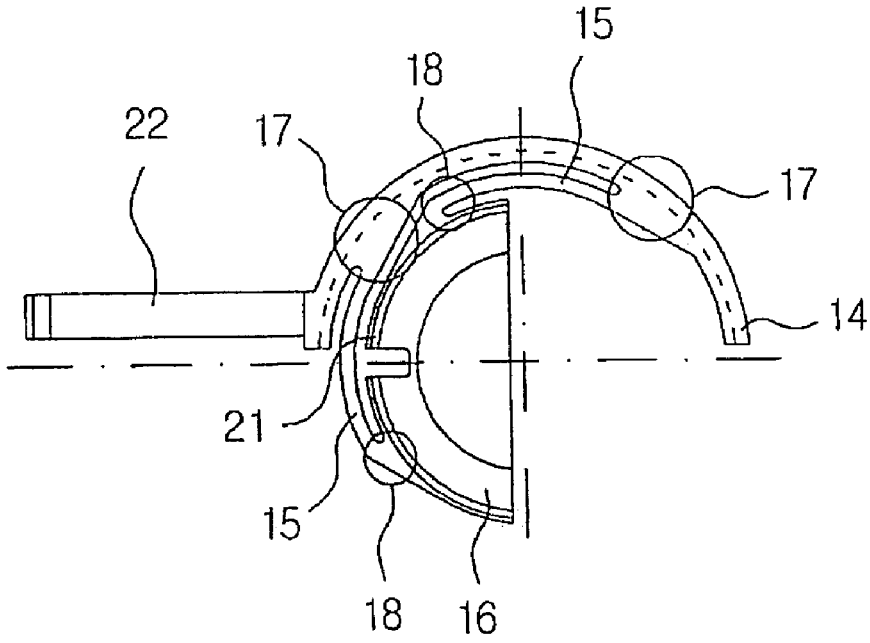
FIGS. 5*a* and 5*b* are plan views of a second suspension according to another embodiment of the present invention.
Figure 5B:
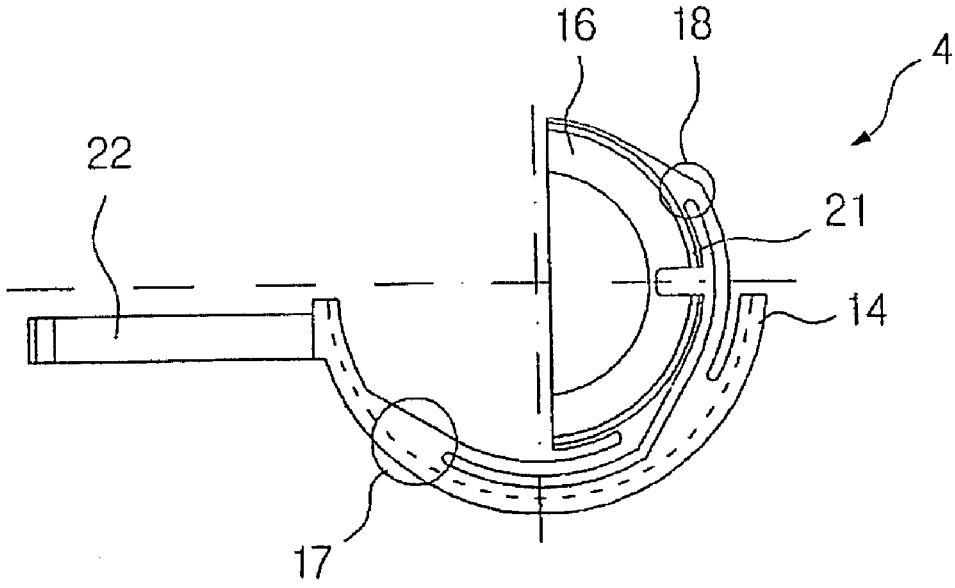

In this embodiment, an electrode terminal portion 22 of each suspension section of the second suspension extends a predetermined length or more to protrude outside of the frame as shown in FIGS. 5*a* and 5*b* and is then bent to form an electrical contact. Accordingly, the electrode terminal portion has tension, so that any additional operation is not required when it is connected to a signal-supplying portion.

Although the present invention has been described in connection with the preferred embodiments, the embodiments are only illustrative and not exhaustive. It will be apparent to those skilled in the art that various modifications and changes or alterations can be made thereto without departing from the scope of the present invention. Therefore, the scope of the present invention should be defined only by the appended claims and construed as covering all the modifications and changes or alterations.

INDUSTRIAL APPLICABILITY

As described above, the present invention provides the micro-speaker with the novel second suspension having the damping diaphragms that can perform functions as soldering or spring type connection electrode terminal portions, vibration dampers, and electrical signal-transmitting passages without disconnection thereof. The micro-speaker of the present invention is constructed, in external appearance, as a single unit with a very small/ultra slim structure equivalent to those of conventional micro-speakers, and enables reproduction of vivid sounds without distortion even though a great deal of electrical signals are input to achieve high level acoustic output. In addition, the micro-speaker of the present invention enables a high reliable electro-acoustic transducer in which disconnection of wires is prevented by damping force of the second suspension to be supplied to the equipment set industry. Furthermore, since three parts are incorporated into one part, the micro-speaker of the present invention can contribute to reduction in production costs due to decreases in raw material costs and the number of manufacturing processes.

The invention claimed is:

1. A micro-speaker including a yoke, a permanent magnet, a plate, a vibration plate with a first suspension integrated therewith, a voice coil, a frame and a protector, comprising:

a second suspension which is made of highly resilient material and installed between the plate and the vibration plate, wherein the voice coil is attached to a lower surface of the second suspension, the vibration plate is attached to an upper surface of the second suspension, and an outer periphery of the second suspension is fixed to the frame, wherein the second suspension is a highly resilient and conductive leaf spring of which a portion protrudes outside of the frame to be connected to a signal-supplying portion, and a lead of the voice coil is connected to the second suspension.

2. The micro-speaker as claimed in claim 1, wherein the second suspension comprises two suspension sections of which shapes are symmetrical with each other, and the two suspension sections are not electrically connected to each other with a predetermined gap there between.

3. The micro-speaker as claimed in claim 2, wherein each of the suspension sections comprises:

a semicircular outer peripheral portion which extends from the electrode terminal portion protruding outside of the frame;

an inner peripheral portion which is spaced apart by a predetermined gap from and arranged perpendicularly to the outer peripheral portion and to which the voice coil and the vibration plate are attached;

damping diaphragms for performing functions of electrically connecting the outer and inner peripheral portions to each other and damping vertical vibration; and a connection portion to which the lead of the voice coil is connected.

4. The micro-speaker as claimed in claim 3, wherein the suspension section is provided with two damping diaphragms, wherein a first damping diaphragm is integrally connected at a position on the outer peripheral portion adjacent to the electrode terminal portion to form a first outer damping support point, and at a position on the inner peripheral portion with a predetermined gap there between to form a first inner damping support point, and a second damping diaphragm is integrally connected at a position on the outer peripheral portion opposite to the electrode terminal portion to form a second outer damping support point, and at another position on the inner peripheral portion with a predetermined gap there between to form a second inner damping support point.

5. The micro-speaker as claimed in claim 1, wherein the protruding portion of the second suspension is bent and fixed to the frame so that the connection of the protruding portion to the signal-supplying portion is made through a spring terminal.

* * * * *